US007559797B2

(12) United States Patent
Shishikura et al.

(10) Patent No.: US 7,559,797 B2
(45) Date of Patent: Jul. 14, 2009

(54) DUMMY PLUG

(75) Inventors: Seiji Shishikura, Chiba (JP); Kazushige Sakamaki, Tokyo (JP)

(73) Assignee: Tyco Electronics AMP K.K., Kanagawa-ken (JP)

( * ) Notice: Subject to any disclaimer, the term of this patent is extended or adjusted under 35 U.S.C. 154(b) by 0 days.

(21) Appl. No.: 12/133,623

(22) Filed: Jun. 5, 2008

(65) Prior Publication Data

US 2008/0305664 A1 Dec. 11, 2008

(30) Foreign Application Priority Data

Jun. 7, 2007 (JP) ..... 2007-151581

(51) Int. Cl.
*H01R 13/40* (2006.01)

(52) U.S. Cl. ..... 439/587; 439/148

(58) Field of Classification Search ..... 439/587, 439/589, 274, 275, 148
See application file for complete search history.

(56) References Cited

U.S. PATENT DOCUMENTS

| | | | | |
|---|---|---|---|---|
| 4,993,964 | A | 2/1991 | Trummer | |
| 4,998,896 | A | 3/1991 | Lundergan | |
| 5,512,047 | A * | 4/1996 | Dvorak | 604/77 |
| 5,551,892 | A | 9/1996 | Endo et al. | |
| 5,707,251 | A | 1/1998 | Sakai | |
| 2001/0024907 | A1 * | 9/2001 | Murakami et al. | 439/587 |
| 2002/0142654 | A1 | 10/2002 | Bobay et al. | |
| 2007/0004279 | A1 | 1/2007 | Mori et al. | |

FOREIGN PATENT DOCUMENTS

| | | |
|---|---|---|
| EP | 1139501 A2 | 10/2001 |
| JP | 09-199219 | 7/1997 |
| JP | 2004-071200 | 3/2004 |

* cited by examiner

*Primary Examiner*—Javaid Nasri
(74) *Attorney, Agent, or Firm*—Barley Snyder LLC

(57) ABSTRACT

A waterproof connector with at least a first dummy plug includes an inner housing provided with a plurality of contact accommodating cavities. A sealing member is provided with a plurality of contact insertion openings corresponding to the contact accommodating cavities. The sealing member is attached to a rear side of the inner housing. An outer housing is provided with a plurality of contact insertion openings corresponding to the contact accommodating cavities. The outer housing secures the sealing member to the inner housing. The first dummy plug has a sealing portion extending into at least one of the contact insertion openings of the sealing member, at least one elastic piece that elastically latches between the inner housing and the outer housing, an insertion member arranged in the contact insertion opening of the outer housing, and a pull-out member that extends outward from the outer housing.

7 Claims, 9 Drawing Sheets

DUMMY PLUG

CROSS-REFERENCE TO RELATED APPLICATIONS

This application claims the benefit of the filing date under 35 U.S.C. § 119(a)-(d) of Japan Patent Application No. 2007-151581, filed Jun. 7, 2007.

FIELD OF THE INVENTION

The present invention relates to a dummy plug that is used in a waterproof connector comprising a family sealing-type sealing member.

BACKGROUND

Waterproof connectors that are commonly used in automobiles and the like are often exposed to harsh environments. In such environments, there is a danger of water or the like entering an interior of a connector through-wire or of dew condensation occurring inside the waterproof connector caused by temperature difference. In order to eliminate such drawbacks and to maintain the airtight state of a waterproof connector that is in a mated state, a separate sealing-type or family sealing-type sealing member is used in the waterproof connector. In general, such sealing members are made of an elastomer.

In a waterproof connector employing the family sealing-type sealing member, contact insertion openings are formed in the sealing member in positions corresponding to contact accomodating cavities formed in the interior of the waterproof connector. Incidentally, not only in the case of the waterproof connector using separate sealing-type sealing members, but also in the waterproof connector using the family sealing-type sealing member, there are cases in which empty cavities where no contacts are accommodated remain among the contact accommodating cavities. A conventionally known method used in such cases involves inserting a dummy plug into each of the contact insertion openings in order to prevent the entry of water from the contact insertion openings corresponding to the empty cavities.

FIG. 7 is a sectional view of a waterproof connector 101 in which a conventional example of a dummy plug 140 is used (see JP2004-071200A). The waterproof connector 101 shown in FIG. 7 comprises a housing 110 having a plurality of contact accommodating cavities 111. Contacts (not shown) are respectively accommodated inside the contact accommodating cavities 111. A tube member 112 that protrudes rearward is provided at the rear end (right end in FIG. 7) of the housing 110. A family sealing-type sealing member 120 for maintaining the airtight state of the waterproof connector 101 that is in a mated state is provided inside the tube member 112. A plurality of contact insertion openings 121 are formed in the sealing member 120 in positions corresponding to the contact accommodating cavities 111. A cover member 130 is attached to the tube member 112 of the housing 110, so that the sealing member 120 is prevented by the cover member 130 from slipping out to the rear. The cover member 130 is attached to the tube member 112 of the housing 110 as a result of a locking projection 113 provided on the tube member 112 of the housing 110 being locked with a locking opening 133 formed in the cover member 130. In addition, a plurality of contact insertion openings 131 are formed in the cover member 130 in positions corresponding to the respective contact accommodating cavities 111.

Furthermore, in order to prevent the entry of water from the contact insertion opening 121 corresponding to an empty cavity among the contact accommodating cavities 111, a dummy plug 140 is inserted into the contact insertion opening 121. The dummy plug 140 comprises an operating member 141 and a sealing portion 142 that extends forward from the operating member 141. The external shape of the operating member 141 is formed so as to correspond to a square-shaped contact insertion opening 131 in the cover member 130. The sealing portion 142 has a circular cylindrical shape having a diameter equivalent to the diameter of an electrical wire (not shown) connected to a contact. The diameter of an electrical wire means the outer diameter of the covering. The sealing portion 142 forms a tight seal with the inner circumference of a projecting rib 121*a* of the contact insertion opening 121 formed in the sealing member 120. When the dummy plug 140 is inserted into the contact insertion opening 121, the sealing portion 142 closes off the contact insertion opening 121, and the sealing portion 142 forms a tight seal with the projecting rib 121 a of the contact insertion opening 121. As a result, the airtight state of the waterproof connector 101 that is in the mated state is maintained. Accordingly, it is possible to prevent the entry of water from the contact insertion opening 121.

Moreover, locking projections 143 that restrict the rearward movement of the dummy plug 140 by entering locking grooves 132 formed in the cover member 130 are provided on the outer surfaces of the operating member 141 of the dummy plug 140. A flange 144 that restricts the forward movement of the dummy plug 140 is provided at the rear end of the operating member 141. Thus, the rearward movement of the dummy plug 140 is restricted by providing the locking projections 143 on the dummy plug 140, which increases the inner pressure of the housing 110, so that it is possible to prevent the dummy plug 140 from slipping out of the contact insertion opening 121 of the sealing member 120.

FIG. 8 is a sectional view of a waterproof connector 201 in which another conventional example of a dummy plug is used (see JP09-199219A). The waterproof connector 201 shown in FIG. 8 comprises a housing 210 having a plurality of contact accommodating cavities 211. Contacts (not shown) are respectively accommodated inside the contact accommodating cavities 211, and a housing lance 212 for performing the primary locking of a contact is provided in each of the contact accommodating cavities 211. Moreover, the contacts (not shown) are designed such the secondary locking of the contacts (not shown) are performed by a side retainer 220 that is inserted from below the housing 210. In addition, a hood member 213 that protrudes rearward is provided on the rear portion (right portion in FIG. 8) of the housing 210, and a family sealing-type sealing member 230 for maintaining the airtight state of the connector that is in the mated state is provided inside the hood member 213. A plurality of contact insertion openings 231 are formed in the sealing member 230 in positions corresponding to the contact accommodating cavities 211. A cover member 240 is attached to the hood member 213 of the housing 210 and is used to prevent the sealing member 230 from slipping out to the rear. A plurality of contact insertion openings 241 are formed in the cover member 240 in positions corresponding to the contact accommodating cavities 211.

Moreover, in order to prevent the entry of water from the contact insertion opening 231 corresponding to an empty cavity among the contact accommodating cavities 211, a dummy plug 250 is inserted into the contact insertion opening 231. The dummy plug 250 comprises an operating member 251, a sealing portion 252 that extends forward from the operating member 251, a locking member 253 that extends forward from the sealing portion 252, and a projection 254 that is provided at the tip end of the locking member 253. The sealing portion 252 is formed with a concavo-convex external shape and forms a tight seal with projecting ribs 231*a* of the contact insertion opening 231 formed in the sealing member 230. When the dummy plug 250 is inserted into the contact insertion opening 231, the sealing portion 252 closes off the contact insertion opening 231, and the sealing portion 252 forms a tight seal with the projecting ribs 231*a* of the contact insertion opening 231. As a result, the airtight state of the waterproof connector 201 that is in the mated state is maintained. Accordingly, it is possible to prevent the entry of water from the contact insertion opening 231. Furthermore, the dummy plug 250 can be prevented from becoming loose and slipping out by the projection 254 engaging with the tip end member 221 of the side retainer 220.

However, several problems have been encountered in the waterproof connectors 101, 201 that respectively use the dummy plugs 140, 250. First, in both the waterproof connectors 101, 201, the constructions are such that no consideration is given to removing the dummy plugs 140, 250 that have once been inserted into contact insertion openings 121, 231, respectively. For example, in waterproof connectors used in automobiles, there are cases in which a dummy plug that has once been inserted into a contact insertion opening is pulled out for the purpose of modifying the circuit structures or the like in vehicles.

In order to pull out the dummy plug 140 in the waterproof connector 101 shown in FIG. 7, it is necessary to perform the work of removing the cover member 130 attached to the tube member 112 of the housing 110 from the tube member 112. The engagement of the locking projection 113 with the locking opening 133 must be released to remove the cover member 130 from the tube member 112, and the working characteristics thereof are extremely poor.

Furthermore, in the waterproof connector 201 shown in FIG. 8, the work of removing the side retainer 220 from the housing 210 is required in order to pull the dummy plug 250. A special tool is required to remove the side retainer 220 from the housing 210, and the working characteristics thereof are extremely poor. Moreover, if the dummy plug 250 is pulled out in the waterproof connector 201, there is the risk of damaging the sealing member 230 when the projection 254 that is provided at the tip end of the dummy plug 250 passes through the contact insertion opening 231 in the sealing member 230. Because the sealing member 230 is a family sealing-type sealing member, if damage occurs to even one location, the entire sealing member 230 must be replaced, and there is a drawback in that all of the electrical wires (not shown) must be removed and inserted for this purpose.

SUMMARY

Accordingly, the present invention was devised to eliminate the problems described above; it is an object of the present invention to provide a dummy plug that can be pulled out easily from a contact insertion opening formed in a family sealing-type sealing member. Furthermore, another object of the present invention is to provide a dummy plug that can avoid the risk of damaging the sealing member when this dummy plug is pulled out of a contact insertion opening formed in a family sealing-type sealing member.

This and other objects are achieved by a dummy plug comprising a sealing portion, an insertion member extending rearward from the sealing portion, a pull-out member extending rearward from the insertion member, and at least one elastic piece that extending diagonally from the dummy plug between the sealing portion and the insertion member.

This and other objects are further achieved by a waterproof connector comprising an inner housing provided with a plurality of contact accommodating cavities. A sealing member is provided with a plurality of contact insertion openings corresponding to the contact accommodating cavities. The sealing member is attached to a rear side of the inner housing. An outer housing is provided with a plurality of contact insertion openings corresponding to the contact accommodating cavities. The outer housing secures the sealing member to the inner housing. At least a first dummy plug has a sealing portion extending into at least one of the contact insertion openings of the sealing member, at least one elastic piece that elastically latches between the inner housing and the outer housing, an insertion member arranged in the contact insertion opening of the outer housing, and a pull-out member that extends outward from the outer housing.

DETAILED DESCRIPTION OF THE EMBODIMENT(S)

Figure 1A:
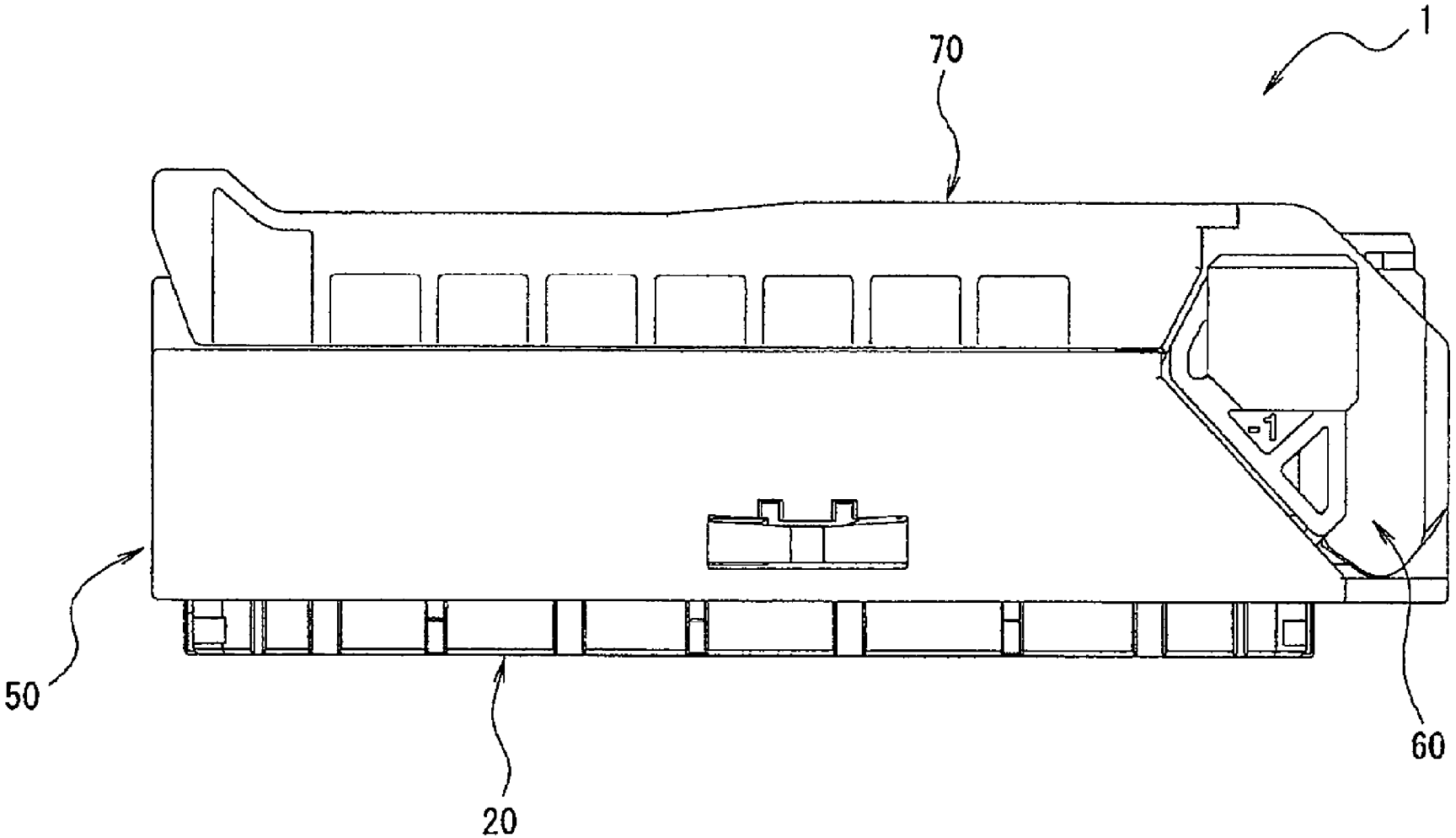
FIGS. 1A, 1B and 1C show a waterproof connector in which first and second dummy plugs constituting the dummy plugs of the present invention are used, with FIG. 1A being a plan view, FIG. 1B being a front view, and FIG. 1C being a rear view.
Figure 1B:
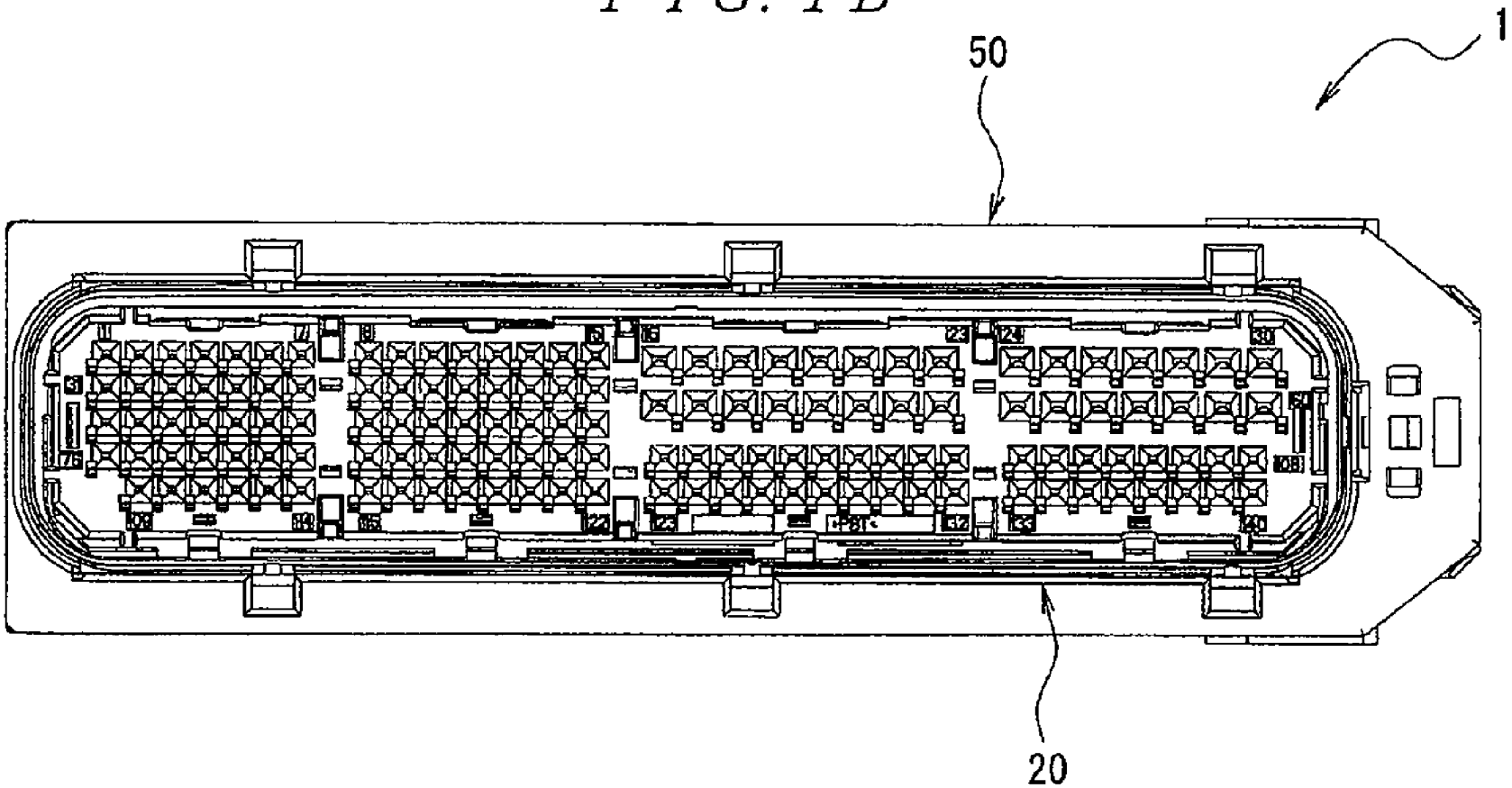

An embodiment of the present invention will be described below with reference to the figures. FIGS. 1A, 1B, 1C, 2A and 2B show a waterproof connector 1 in which first and second dummy plugs 80A, 80B constituting the dummy plugs of the present invention are used. The waterproof connector 1 is a so-called lever-type connector and comprises an inner housing 10, a front cover 20, a retainer 30, a mating connector sealing member (not shown), a sealing member 40, an outer housing 50, a slider 60, a lever 70, and a wiring cover (not shown).

Figure 2A:
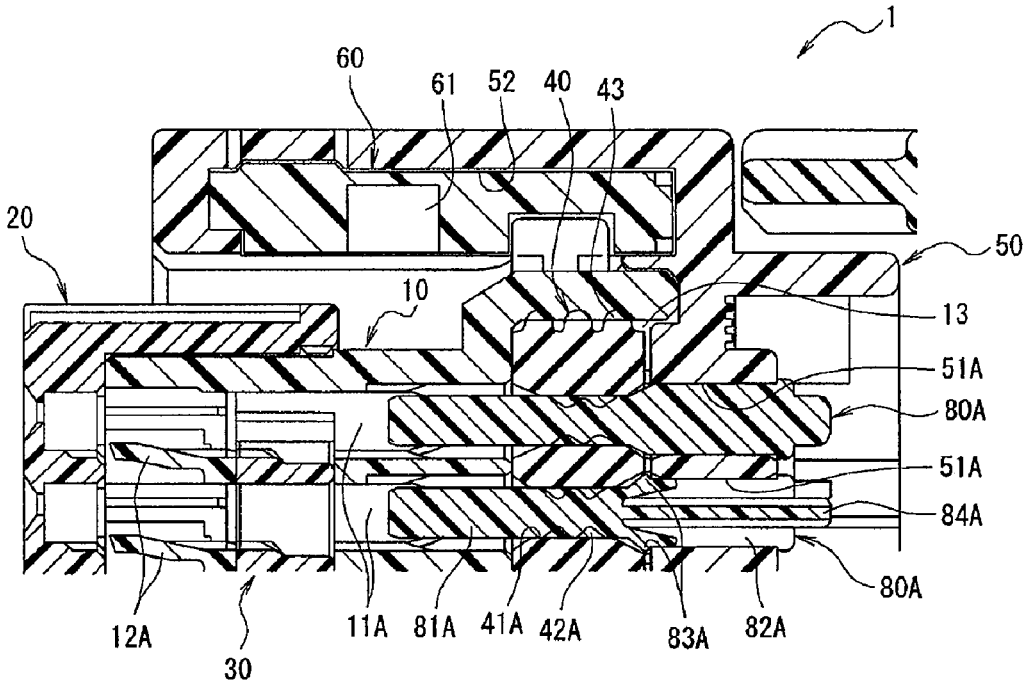
FIGS. 2A and 2B show the waterproof connector of FIGS. 1A, 1B and 1C, with FIG. 2A being a sectional view along line 2A-2A in FIG. 1C, and FIG. 2B being a sectional view along line 2B-2B in FIG. 1C.

The inner housing 10 is formed in a substantially rectangular parallelepiped shape that extends in the direction of width (direction perpendicular to the plane of page in FIG. 2A), in the vertical direction (vertical direction in FIG. 2A), and in the forward-rearward direction (left-right direction in FIG. 2A). A plurality of contact accommodating cavities 11A (see FIG. 2A) that pass through in the forward-rearward direction and that are used to accommodate power contacts (not shown) and a plurality of contact accommodating cavities 11B (see FIG. 2B) that pass through in the forward-rearward direction and that are used to accommodate signal contacts (not shown) are formed in the inner housing 10. A housing lance 12A for performing the primary locking of the power contacts (not shown) is provided in each of the contact accommodating cavities 11A, and a housing lance 12B for performing the primary locking of the signal contacts (not shown) is provided in each of the contact accommodating cavities 11B.

The front cover 20 is designed to be mounted on the front side of the inner housing 10. The retainer 30 is designed to be mounted from the underside of the inner housing 10 and to perform the secondary locking of the power contacts and signal contacts. The mating connector sealing member (not shown) is designed to be mounted on the outer circumference of the inner housing 10, and to form a seal between the inner housing 10 and a mating connector (not shown), thus preventing the entry of water into the interior of the inner housing 10 from the mating member.

The sealing member 40 is a family sealing-type sealing member. The sealing member 40 is formed substantially in a plate form and is designed to be accommodated inside a sealing member accommodating recessed member 13 formed in the rear side of the inner housing 10. The sealing member 40 is made of an elastomer. A plurality of projecting ribs 43 that form a tight seal with the inner circumferential surface of the inner housing 10 are provided on the outer circumferential surface of the sealing member 40. A plurality of contact insertion openings 41A are formed in the sealing member 40 in positions corresponding to the contact accommodating cavities 11A. A plurality of contact insertion openings 41B are formed in positions corresponding to the contact accommodating cavities 11B.

Electrical wires (not shown) connected to the power contacts (not shown) are accommodated in the contact accommodating cavities 11A and are led out rearward, passing through the contact insertion openings 41A, while electrical wires (not shown) connected to the signal contacts (not shown) that are accommodated in the contact accommodating cavities 11B are led out rearward, passing through the contact insertion openings 41B. A plurality of projecting ribs 42A, 42B are provided on inner circumferences of the contact insertion openings 41A, 41B, respectively. The projecting ribs 42A, 42B form a tight seal with the outer circumferential surfaces of the electrical wires (not shown), thus maintaining the airtight state of the connector that is in the mated state.

Accordingly, it is possible to block the entry of water into the interior of the inner housing 10 from the contact insertion openings 41A, 41B. The diameter of the electrical wires (not shown) connected to the power contacts (not shown) is greater than the diameter of the electrical wires (not shown) connected to the signal contacts (not shown), and the diameter is approximately 1.0 mm. In contrast, the diameter of the electrical wires (not shown) connected to the signal contacts (not shown) is approximately 0.5 mm. The diameter of the electrical wires (not shown) means the outer diameter of the coverings.

Figure 1C:
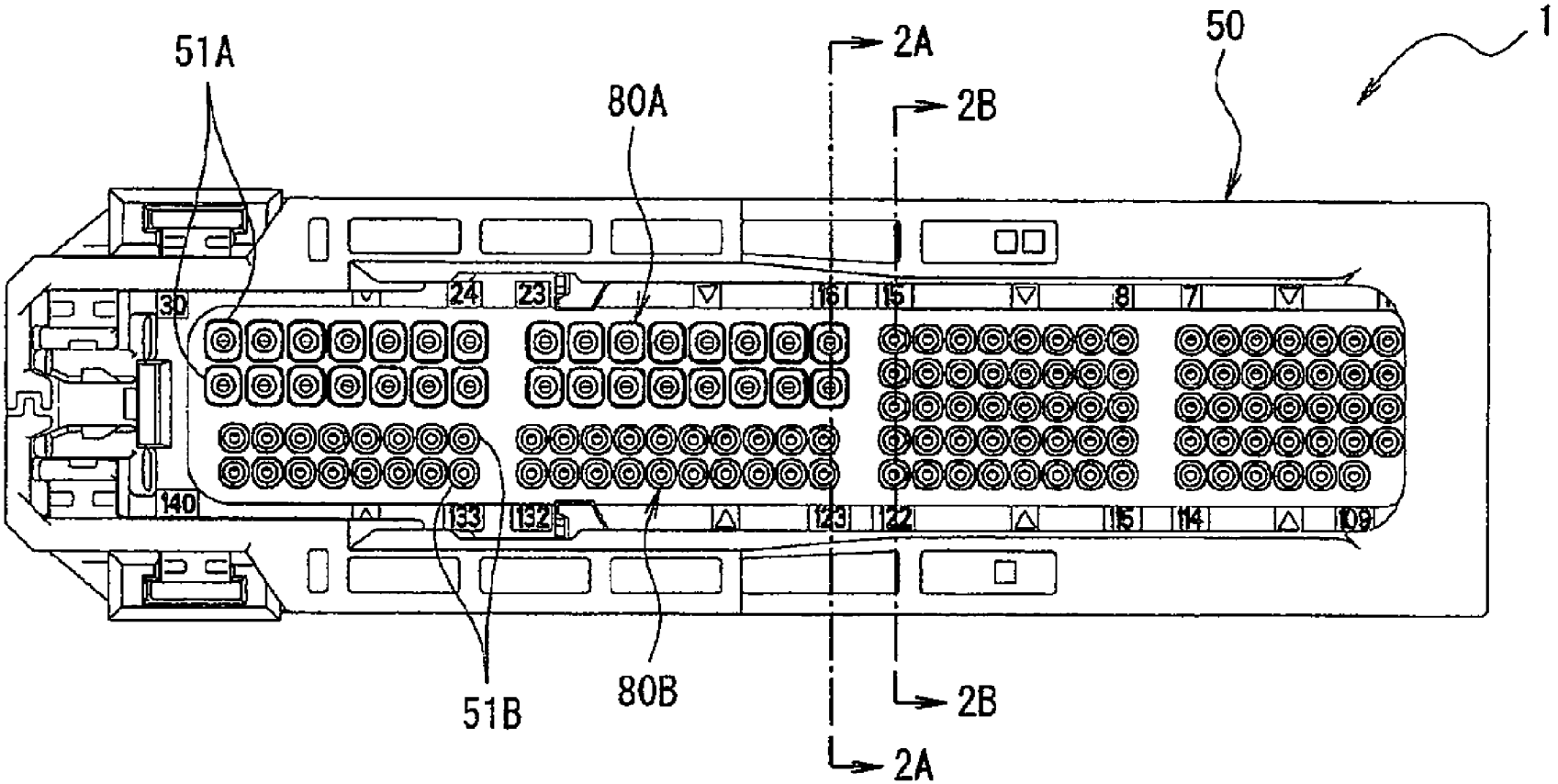
Figure 2B:
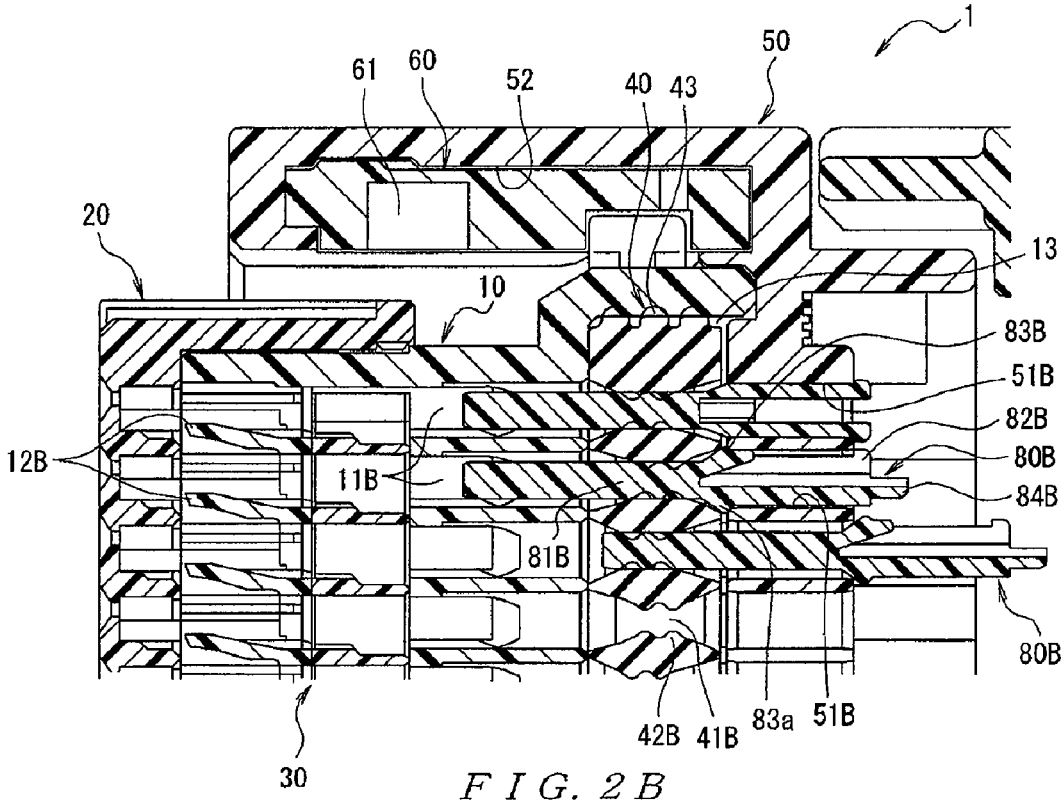

Moreover, the outer housing 50 is designed to be mounted on the rear side of the inner housing 10 and to prevent the sealing member 40 from slipping out. As is shown in FIGS. 1C and 2A, a plurality of contact insertion openings 51A are formed in the outer housing 50 in positions corresponding to the contact accommodating cavities 11A. Furthermore, as shown in FIGS. 1C and 2B, a plurality of contact insertion openings 51B are formed in the outer housing 50 in positions corresponding to the contact accommodating cavities 11B. The electrical wires (not shown) connected to the power contacts (not shown) are led out rearward, passing through the contact insertion openings 51A, while the electrical wires (not shown) connected to the signal contacts (not shown) are led out rearward, passing through the contact insertion openings 51B. A pair of slider accommodating grooves 52 that extend in the direction of width are formed in the upper and lower portions of the outer housing 50. The wiring cover is designed to be attached to the rear side of the outer housing 50 and to guide a bundle of the electrical wires (not shown) that are led out rearward from the outer housing 50 in one specified direction.

The slider 60 is accommodated inside the slider accommodating grooves 52 in a manner capable of sliding movements. A cam groove 61 where a cam pin (not shown) provided on the mating connector enters is formed in the inner surface of the slider 60. The slider 60 makes sliding movements by the operation of the lever 70, and this is accompanied by the actions of the cam groove 61 and cam pin to cause the mating connector to mate with or to be separated from the connector.

In the waterproof connector 1 constructed in this manner, there are cases in which empty cavities where no power contacts (not shown) or signal contacts (not shown) are accommodated remain among the contact accommodating cavities 11A, 11B. In cases where an empty cavity in which none of the power contacts (not shown) are accommodated remains, the first dummy plug 80A shown in FIGS. 2A, 2B, 3A, 3B, 4A, 4B, 4C, 4D and 4E is used. In cases where an empty cavity in which none of the signal contacts (not shown) are accommodated remains, the second dummy plug 80B shown in FIGS. 2A, 2B, 5A, 5B, 6A, 6B, 6C, 6D and 6E is used. As is shown in FIG. 2A, the first dummy plugs 80A are respectively inserted into the contact insertion openings 41A in the sealing member 40 from the rear of the outer housing 50. Each of the first dummy plugs 80A comprises a sealing portion 81A, an insertion member 82A that extends rearward (rightward in FIG. 2A) from the sealing portion 81A, a pair of elastic pieces 83A, and a pull-out member 84A that extends rearward from the insertion member 82A. Each of the first dummy plugs 80A is formed as an integral unit by molding a synthetic resin.

The sealing portion 81A is formed in a circular cylindrical shape having the same diameter as the diameter of the electrical wire (not shown) connected to the power contact (not shown), so that the sealing portion 81A forms a tight seal with the inner circumferences of the projecting ribs 42A of a contact insertion opening 41A when inserted into the contact insertion opening 41A. When the sealing portion 81A is inserted into a contact insertion opening 41A, the sealing portion 81A closes off the contact insertion opening 41A, and the projecting ribs 42A form a tight seal with the outer circumference of the sealing portion 81A, so that no gap is created. As a result, the airtight state of the connector that is in the mated state can be maintained. Accordingly, it is possible to block the entry of water into the interior of the inner housing 10 from each of the contact insertion openings 41A.

Figure 3A:
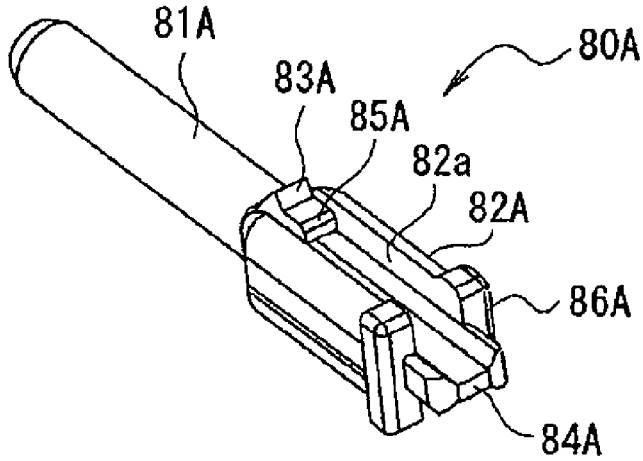
FIGS. 3A and 3B show a first dummy plug, with FIG. 3A being a perspective view as seen at an inclination from above, and FIG. 3B being a perspective view as seen at an inclination from below.
Figure 3B:
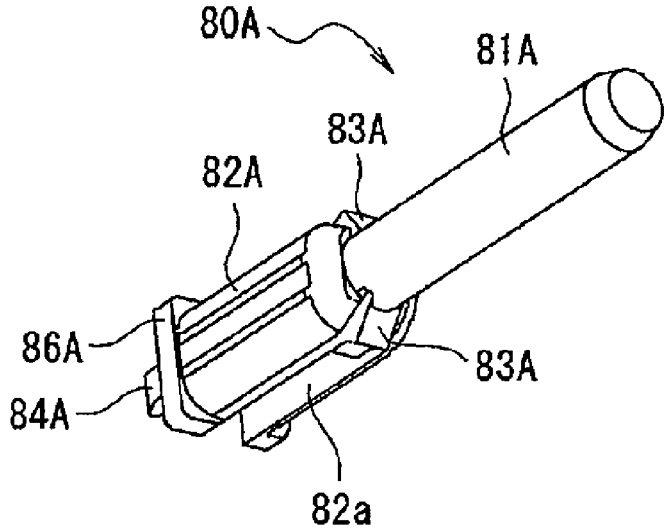

The insertion member 82A extends rearward from the sealing portion 81A, and is constructed by forming slits 82*a* in a substantially rectangular parallelepiped-shaped member from above and below as shown in FIGS. 3A and 3B. The sealing portion 81A of a first dummy plug 80A is inserted from the rear of the outer housing 50 via a contact insertion opening 51A into the contact insertion opening 41A, with the insertion member 82A and the area in the vicinity of this member being held between fingers. As is shown in FIG. 2A, the insertion member 82A is designed to be positioned inside the contact insertion opening 51A in the outer housing 50 when the insertion of the first dummy plug 80A is completed. Because the contacts that are accommodated inside the contact accommodating cavities 11A have a rectangular cross-sectional surface, the contact accommodating cavities 11A are formed such that the transverse cross-sectional shape thereof is rectangular. The shape of the insertion members 82A is a substantially rectangular parallelepiped so as to conform to the transverse cross-sectional shape of the contact accommodating cavities 11A. Furthermore, because the insertion members 82A have a substantially rectangular parallelepiped shape, it is possible to prevent the first dummy plugs 80A from rotating inside the respective contact insertion openings 51A.

Figure 4A:
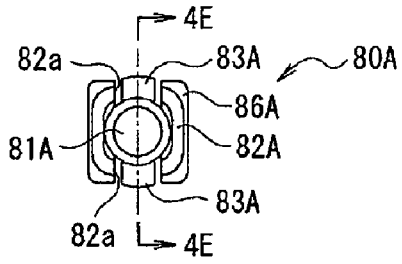
FIGS. 4A, 4B, 4C, 4D and 4E show a first dummy plug of FIGS. 3A and 3B, with FIG. 4A being a front view, FIG. 4B being a left side view, FIG. 4C being a plan view, FIG. 4D being a rear view, and FIG. 4E being a partial sectional view along line 4E-4E in FIG. 4A.
Figure 4B:
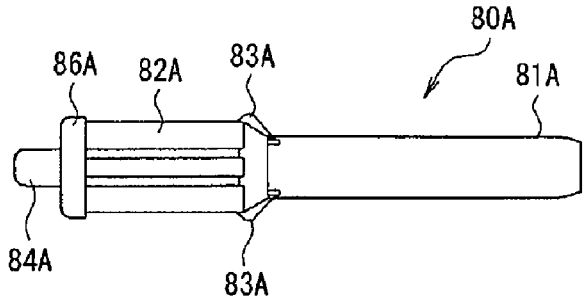
Figure 4C:
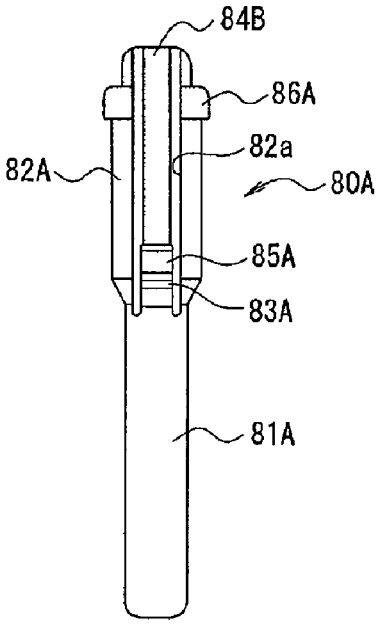
Figure 4D:
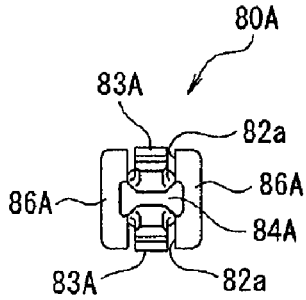
Figure 4E:
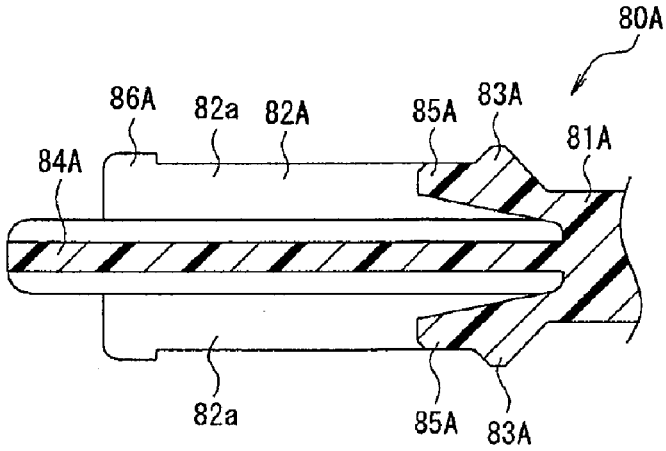

As shown in FIG. 4E, the elastic pieces 83A extend diagonally rearward from the upper and lower corner edges at the rear end of the sealing portion 81A so as to respectively open upward and downward into a cantilever shape. As shown in FIG. 2A, each of the elastic pieces 83A is designed to latch on the front end edge of a contact insertion opening 51A in the outer housing 50 that is disposed to the rear side of the sealing member 40 when the insertion of the first dummy plug 80A is completed. A construction is used which is such that the elastic pieces 83A latch on the front end edges of the contact insertion opening 51A, and this latching is accomplished by utilizing the gap between the sealing member 40 and the outer housing 50, so that a space reduction can be achieved, making the first dummy plug 80A suitable for reducing the pitch.

Furthermore, when the sealing portion 81A of the first dummy plug 80A is inserted into the corresponding contact insertion opening 41A, the elastic pieces 83A respectively advance along the upper and lower surfaces of the contact insertion opening 51A in the outer housing 50 in a state in which the elastic pieces 83A flex elastically inward (i.e., the elastic piece 83A flexes upward, and the elastic piece 83A flexes downward), and when the insertion of the first dummy plug 80A is completed, the elastic pieces 83A return to the original state, and latch on the front end edges of the contact insertion opening 51A in the outer housing 50. When the elastic pieces 83A latch on the front end edges of the contact insertion opening 51A, the rearward movement of the first dummy plug 80A is restricted. The force that restricts the rearward movement of the first dummy plug 80A in this case, i.e., the holding force, is determined by the elastic force of the elastic pieces 83A. If the latching portions are constructed from a member that does not elastically deform, it is difficult to adjust this holding force because the thickness of the latching portions needs to be varied. On the other hand, if the latching portions are constructed so as to be capable of elastic deformation as in the first dummy plug 80A, and this elastic force is used to adjust the holding force described above, then this adjustment can be performed easily.

The pull-out member 84A extends rearward in a plate form from the central portion in the vertical direction and left-right direction of the rear end surface of the insertion member 82A. The sealing portion 81A of the first dummy plug 80A can be pulled out rearward through the corresponding contact insertion opening 51A in the outer housing 50 by holding the pull-out member 84A between fingers and pulling this pull-out member 84A rearward. Accordingly, the first dummy plug 80A can be pulled out easily from the corresponding contact insertion opening 41A with a simple operation. When the sealing portion 81A of the first dummy plug 80A is pulled out, the elastic pieces 83A flex elastically inward (i.e., the elastic piece 83A flexes upward, and the elastic piece 83A flexes downward), thus releasing the latched state. Moreover, the elastic pieces 83A respectively advance along the upper and lower surfaces of the corresponding contact insertion opening 51A in the outer housing 50, and return to the original state upon the completion of the insertion of the first dummy plug 80A. Accordingly, the elastic pieces 83A are not in the way during the work of pulling out the first dummy plug 80A.

The elastic pieces 83A are designed to latch on the front end edges of the contact insertion opening 51A in the outer housing 50 that is disposed to the rear side of the sealing member 40 when the insertion of the first dummy plug 80A is completed. Because the respective elastic pieces 83A latch on the portions located to the rear side of the sealing member 40, there is no damage to the sealing member 40 when the sealing portion 81A of the first dummy plug 80A is pulled out by being pulled rearward.

Flanges 86A that protrude in the vertical direction and left-right direction are provided at the rear end of the insertion member 82A. When the elastic pieces 83A latch on the front end edges of the corresponding contact insertion opening 51A upon the completion of the insertion of the first dummy plug 80A, the flanges 86A contact the rear end surface of the outer housing 50, thus restricting the forward movement of the first dummy plug 80A.

An extension member 85A that enters a contact insertion opening 51A in the outer housing 50 is provided on each of the elastic pieces 83A. The extension members 85A respectively extend rearward from the elastic pieces 83A, and stay in the contact insertion opening 51A even when the insertion of the first dummy plug 80A is completed and the elastic pieces 83A latch on the front end edges of the contact insertion opening 51A. Accordingly, when each of the elastic pieces 83A latches on the front end edge of the contact insertion opening 51A, excessive outward displacement of the elastic pieces 83A can be restricted. If each of the elastic pieces 83A is excessively displaced outward at the time of latching, the elastic pieces 83A abut against the front end surface of the outer housing 50 when the first dummy plug 80A is to be pulled out, so that it becomes difficult to pull out the first dummy plug 80A. Accordingly, by restricting the excessive outward displacement of the elastic pieces 83A, the work of pulling out the first dummy plug 80A can be performed more easily.

The second dummy plugs 80B are respectively inserted into the contact insertion openings 41B in the sealing member 40 from the rear of the outer housing 50. Each of the second dummy plugs 80B comprises a sealing portion 81B, an insertion member 82B that extends rearward from the sealing portion 81B, an elastic piece 83B, a projection 83Ba that does not undergo elastic displacement, and a pull-out member 84B that extends rearward from the insertion member 82B. Each of the second dummy plugs 80B is formed as an integral unit by molding a synthetic resin.

The sealing portion 81B is formed in a circular cylindrical shape having the same diameter as the diameter of the electrical wire (not shown) connected to the signal contact (not shown), so that the sealing portion 81B forms a tight seal with the inner circumferences of the projecting ribs 42B of a contact insertion opening 41B when inserted into the contact insertion opening 41B. When the sealing portion 81B is inserted into a contact insertion opening 41B, the sealing portion 81B closes off the contact insertion opening 41B, and the projecting ribs 42B form a tight seal with the outer circumference of the sealing portion 81B, so that no gap is created. As a result, the airtight state of the connector that is in the mated state can be maintained. Accordingly, it is possible to block the entry of water into the interior of the inner housing 10 from each contact insertion opening 41B.

Figure 5A:
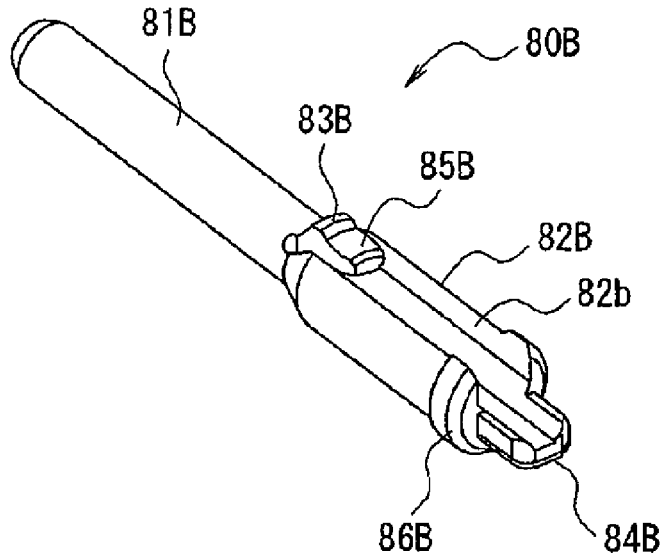
FIGS. 5A and 5B show a second dummy plug, with FIG. 5A being a perspective view as seen at an inclination from above, and FIG. 5B being a perspective view as seen at an inclination from below.
Figure 5B:
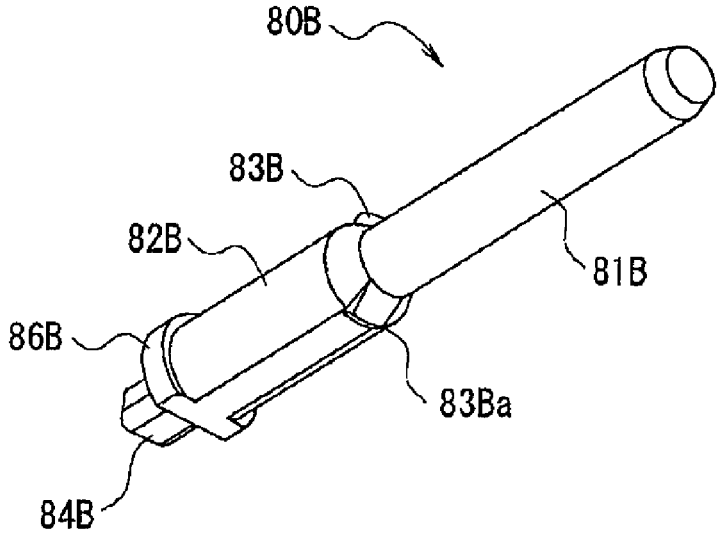

The insertion member 82B extends rearward from the sealing portion 81B and is constructed by forming a slit 82*b* in a substantially circular cylindrical member from above as shown in FIG. 5A. The sealing portion 81B of a second dummy plug 80B is inserted from the rear of the outer housing 50 via a contact insertion opening 51B into the corresponding contact insertion opening 41B, with the insertion member 82B and the area in the vicinity of this member being held between fingers. As is shown in FIG. 2B, the insertion member 82B is designed to be positioned inside the contact insertion opening 51B in the outer housing 50 when the insertion of the second dummy plug 80B is completed. Because the insertion member 82B has a substantially circular cylindrical shape, the rotation of the second dummy plug 80B inside the contact insertion opening 51B cannot be prevented. However, the positioning work in the rotating direction is not required when the sealing portion 81B is inserted into the corresponding contact insertion opening 41B, so that the working characteristics in the insertion of the sealing portion 81B can be made favorable. In particular, the sealing portion 81B of the second dummy plug 80B is formed in a circular cylindrical shape having the same diameter as the diameter of the electrical wire (not shown) connected to a signal contact, so that the second dummy plug 80B is small. Therefore, it is important to enhance the insertion working characteristics.

Figure 6A:
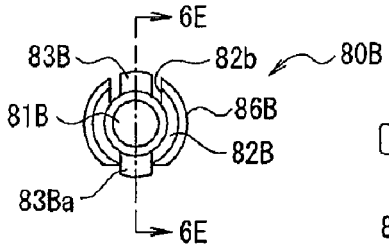
FIGS. 6A, 6B, 6C, 6D and 6E show the second dummy plug of FIGS. 5A and 5B, with FIG. 6A being a front view, FIG. 6B being a left side view, FIG. 6C being a plan view, FIG. 6D being a rear view, and FIG. 6E being a partial sectional view along line 6E-6E in FIG. 6A.
Figure 6B:
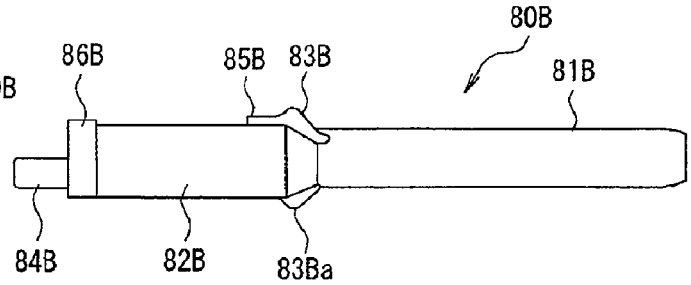
Figure 6C:
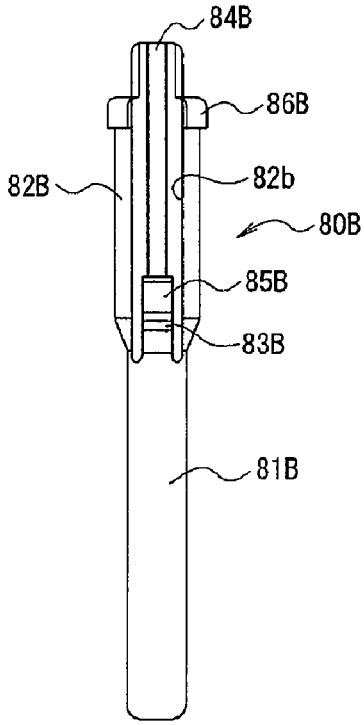
Figure 6D:
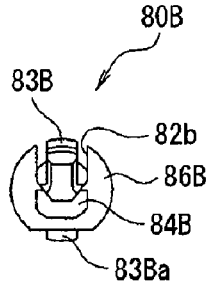
Figure 6E:
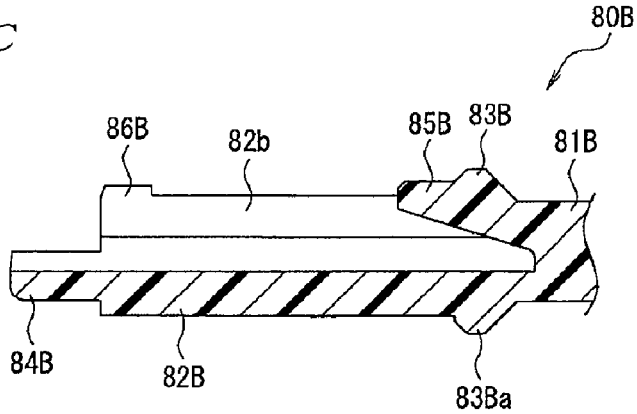
Figure 7:
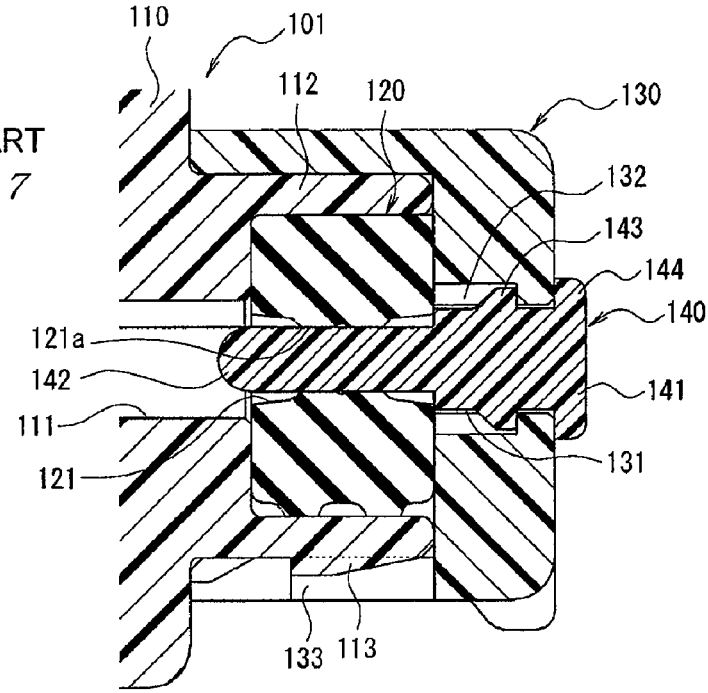
PRIOR ART F I G. 7
FIG. 7 is a sectional view of a waterproof connector in which a conventional example of a dummy plug is used.
Figure 8:
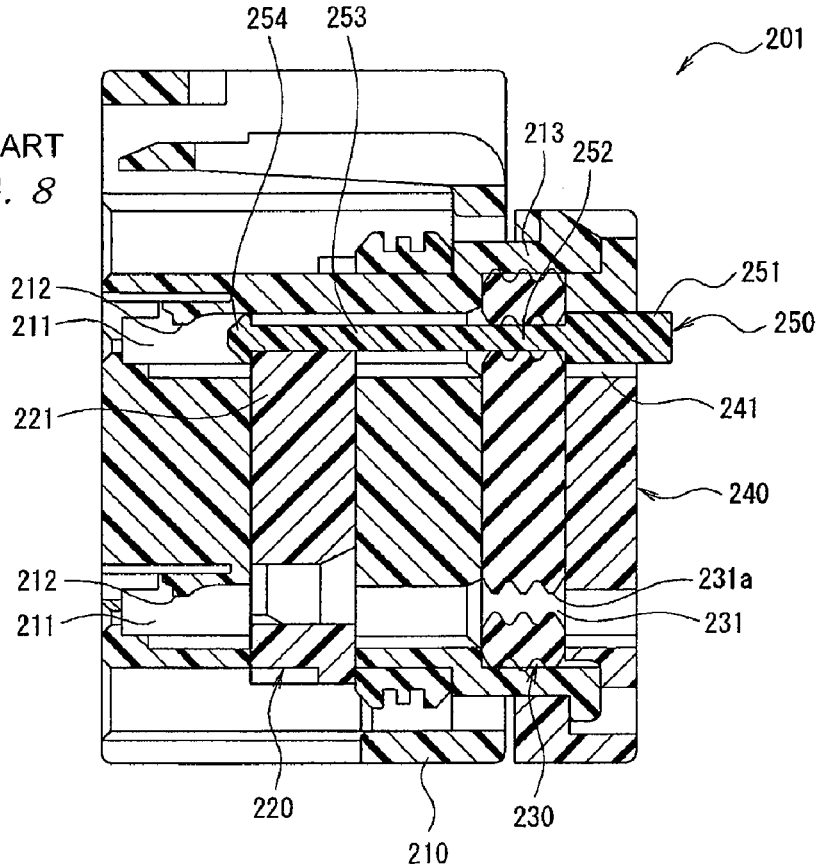
PRIOR ART F I G. 8
FIG. 8 is a sectional view of a waterproof connector in which another conventional example of a dummy plug is used.

Moreover, as is shown in FIG. 6E, the elastic piece 83B extends rearward into a cantilever shape so as to extend diagonally upward from the upper corner edge at the rear end of the sealing portion 81B. The projection 83Ba that does not undergo elastic deformation protrudes from the lower end of the insertion member 82B so as to be symmetrical with the elastic piece 83B in the vertical direction. As shown in FIG. 2B, the elastic piece 83B and projection 83Ba are designed to latch on the front end edges of the corresponding contact insertion opening 51B in the outer housing 50 that is disposed to the rear side of the sealing member 40 at the completion of the insertion of the second dummy plug 80B. A construction is used which is such that the elastic piece 83B and projection 83Ba latch on the front end edges of the contact insertion opening 51B, and this latching is accomplished by utilizing the gap between the sealing member 40 and the outer housing 50, so that a space reduction can be achieved, making it possible to meet the demand for reducing the pitch. When the sealing portion 81B of the second dummy plug 80B is inserted into the corresponding contact insertion opening 41B, the elastic piece 83B advances along the upper surface of the contact insertion opening 51B in the outer housing 50 in a state in which the elastic piece 83B flexes elastically downward, and when the insertion of the second dummy plug 80B is completed, the elastic piece 83B returns to the original state, and latches on the front end edge of the contact insertion opening 51B in the outer housing 50. The projection 83Ba advances along the lower surface of the contact insertion opening 51B in the outer housing 50 while being slightly scrunched without flexing upward, and when the insertion of the second dummy plug 80B is completed, the projection 83Ba latches on the front end edge of the contact insertion opening 51B in the outer housing 50. As a result, the rearward movement of the second dummy plug 80B is restricted.

Furthermore, the pull-out member 84B extends rearward in a plate form from the central portion in the left-right direction and a slightly lower portion in the vertical direction of the rear end surface of the insertion member 82B. The sealing portion 81B of the second dummy plug 80B can be pulled out rearward through the corresponding contact insertion opening 51B in the outer housing 50 by holding the pull-out member 84B between fingers and pulling the pull-out member 84B rearward. When the sealing portion 81B of the second dummy plug 80B is pulled out, the elastic piece 83B flexes elastically downward, so that the latched state is released. Moreover, the elastic piece 83B advances along the upper surface of the corresponding contact insertion opening 51B in the outer housing 50, and returns to the original state upon the completion of the insertion of the second dummy plug 80B. Accordingly, the elastic piece 83B is not in a way during the work of pulling out the second dummy plug 80B. In this case, furthermore, the projection 83Ba advances along the lower surface of the contact insertion opening 51B in the outer housing 50 while being slightly scrunched without flexing upward, and when the insertion of the second dummy plug 80B is completed, the projection 83Ba returns to the original state.

Moreover, the elastic piece 83B and projection 83Ba are designed to latch on the front end edges of the corresponding contact insertion opening 51B in the outer housing 50 disposed to the rear side of the sealing member 40 when the insertion of the second dummy plug 80B is completed. Because the elastic piece 83B and projection 83Ba latch on the portions located to the rear side of the sealing member 40, there is no damage to the sealing member 40 when the sealing portion 81B of the second dummy plug 80B is pulled out by being pulled rearward.

Furthermore, a flange 86B that protrudes in the vertical direction and left-right direction are provided on the rear end surface of the insertion member 82B. When the elastic piece 83B and projection 83Ba latch on the front end edges of the corresponding contact insertion opening 51B upon the completion of the insertion of the second dummy plug 80B, the flange 86B contacts the rear end surface of the outer housing 50, so that the forward movement of the second dummy plug 80B is restricted.

Moreover, an extension member 85B that enters a contact insertion opening 51B in the outer housing 50 is provided on the elastic piece 83B. The extension member 85B extends rearward from the elastic piece 83B, and stays in the contact insertion opening 51B even when the insertion of the second dummy plug 80B is completed and the elastic piece 83B latches on the front end edge of the contact insertion opening 51B. Accordingly, when the elastic piece 83B latches on the front end edge of the contact insertion opening 51B, excessive upward displacement of the elastic piece 83B can be restricted.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A dummy plug, comprising:

a sealing portion;

an insertion member extending rearward from the sealing portion;

a pull-out member extending rearward from the insertion member; and at least one elastic piece that extends diagonally from the dummy plug between the sealing portion and the insertion member, and includes an extension member integrally formed therewith, that extends into a slit in the insertion member.

2. The dummy plug of claim 1, wherein the sealing portion has a circular cylindrical shape and the insertion member has a substantially rectangular parallelepiped shape.

3. The dummy plug of claim 1, wherein the elastic piece has a cantilever shape.

4. The dummy plug of claim 1, wherein a flange is arranged between the pull-out member and the insertion member.

5. The dummy plug of claim 1, wherein the sealing portion has a circular cylindrical shape and the insertion member has a substantially circular cylindrical shape.

6. The dummy plug of claim 1, wherein a non-deformable projection extends from the dummy plug between the sealing portion and the insertion member.

7. The dummy plug of claim 1, wherein the dummy plug is integrally formed from molding a synthetic resin.

* * * * *